US007628208B2

(12) United States Patent
Lovie et al.

(10) Patent No.: US 7,628,208 B2
(45) Date of Patent: Dec. 8, 2009

(54) SYSTEM AND METHOD FOR SECURE OFFSHORE STORAGE OF CRUDE OIL NATURAL GAS OR REFINED PETROLEUM PRODUCTS

(76) Inventors: Peter Lovie, P.O. Box 19733, Houston, TX (US) 77224; Phil H. Nugent, P.O. Box 19733, Houston, TX (US) 77224; Peter Okundaye, P.O. Box 19733, Houston, TX (US) 77224

( * ) Notice: Subject to any disclaimer, the term of this patent is extended or adjusted under 35 U.S.C. 154(b) by 159 days.

(21) Appl. No.: 11/732,033

(22) Filed: Apr. 2, 2007

(65) Prior Publication Data

US 2007/0283870 A1 Dec. 13, 2007

Related U.S. Application Data

(60) Provisional application No. 60/791,608, filed on Apr. 11, 2006, provisional application No. 60/879,842, filed on Jan. 11, 2007.

(51) Int. Cl.
*B65D 88/78* (2006.01)

(52) U.S. Cl. ..... 166/364; 166/250.15; 405/210

(58) Field of Classification Search ..... 405/210; 166/345, 352, 353, 354, 366, 367; 114/230.1, 114/230.12

See application file for complete search history.

(56) References Cited

U.S. PATENT DOCUMENTS

| | | | | |
|---|---|---|---|---|
| 6,983,712 | B2 * | 1/2006 | Cottrell et al. | 114/230.15 |
| 2002/0157833 | A1 * | 10/2002 | Wilson | 166/344 |
| 2004/0069492 | A1 * | 4/2004 | Smith | 166/336 |

* cited by examiner

*Primary Examiner*—David J Bagnell
*Assistant Examiner*—Benjamin Fiorello

(57) ABSTRACT

A system for the storage of crude oil, natural gas and/or refined petroleum products at an offshore location includes a group of tanker vessels or concrete structures on the ocean floor attached to a manifold. The manifold is connected to sources of crude oil, natural gas and/or refined petroleum products. Each vessel includes a security system and a moving arrangement which allows the vessel to weathervane in response to wind and wave forces.

9 Claims, 4 Drawing Sheets

SYSTEM AND METHOD FOR SECURE OFFSHORE STORAGE OF CRUDE OIL NATURAL GAS OR REFINED PETROLEUM PRODUCTS

CROSS REFERENCED TO RELATED APPLICATIONS

This application claims the benefit of Provisional U.S. Patent Application 60/791,608 filed Apr. 11, 2006 and Provisional U.S. Patent Application 60/879,842 filed Jan. 11, 2007.

STATEMENT REGARDING FEDERALLY FUNDED RESEARCH AND DEVELOPMENT

The invention described in this patent application was not the subject of federally sponsored research or development.

FIELD

The present invention pertains to the storage of crude oil, refined liquid petroleum products or gaseous hydrocarbons; more particularly, the present invention pertains to the secure storage of crude oil at offshore locations by oil or gas producing countries, countries with oil or gas refineries, oil or gas using countries, or countries that use products produced from oil or gas.

BACKGROUND

In many third world countries, Nigeria being a prime example, the export of crude oil produced from subterranean or subsea reservoirs has provided a great source of income. It is well known that with the ever increasing price of oil, the crude oil that has been produced from either subterranean or subsea reserves has great economic and political value. It is also well known that the crude oil is typically stored before it is exported to refineries for further processing into a myriad of other products. Should the storage facilities for the crude oil be attacked for the purpose of either destroying the stored oil, making a political statement or simply theft—the potential revenue to be obtained from the sale of the exported crude oil would be lost. A summary of the attacks on oil and gas facilities by the Movement for the Emancipation of the Niger Delta (MEND) and others appeared in the February 2007 issue of *National Geographic Magazine*. Another dramatic example of the destruction of oil and gas facilities which gained international attention was by the loss of millions of dollars of value associated with crude oil when the Kuwaiti oil wells and oil storage facilities were set ablaze during the departure of the Iraqi forces from Kuwait before the Gulf War in the early 1990's.

In recent years, the value of natural gas has increased significantly. While the value of natural gas may not be as high as the value of crude oil to some, the explosive potential of natural gas makes it an excellent target of choice for terrorists intent on making a dramatic political statement.

Similarly, even smaller quantities of refined petroleum products provide an opportune target of choice for those whose purpose is to draw attention or create an atmosphere of terror by setting off a large explosion.

Accordingly, the governments in many countries are concerned with the secure storage of large quantities of crude oil, natural gas, and refined petroleum products before export to other countries. These countries have a great need for systems in which crude oil, natural gas, or refined petroleum products may be stored so that the crude oil, natural gas, or refined petroleum products are protected from those who are motivated to either divert or destroy the crude oil, natural gas, or refined petroleum products before they can either be exported to another country or shipped to an end user.

SUMMARY

The secure crude oil, natural gas and refined petroleum products storage system and method of the present invention provides for the secure storage of crude oil, natural gas and/or refined petroleum products to protect them against those who are motivated to either divert or destroy the crude oil, natural gas and/or refined petroleum products before export or shipment to an end user.

The primary function of the disclosed system and method for the secure storage of crude oil, natural gas and/or refined petroleum products is to provide a means of secure storage at a location beyond the easy reach of militants and others intent on disrupting either the export or shipment of crude oil, natural gas and/or refined petroleum products particularly from third world countries.

The disclosed system and method establishes a remotely located secure offshore strategic crude oil, natural gas and/or refined petroleum products storage reserve that will enable continued exports or shipments to end users despite disruptions at onshore facilities.

Further, the disclosed system and method will provide redundant storage for export terminals. Such redundant storage will serve as a deterrent to the plans of militants and others intent on disrupting the export or shipment of crude oil, natural gas or refined petroleum products as there will be additional routes through which countries may export crude oil, natural gas or refined petroleum products A secondary function for the disclosed system and method is the enablement of the strategic secure storage of crude oil, natural gas, and/or refined petroleum products reserves that will provide a way of profiting from short-term demand spikes or unanticipated price movements; specifically, crude oil, natural gas, or refined petroleum products will be quickly available for export or shipment during short-term demand spikes or unexpected changes in commodity prices.

The disclosed system and method envisions the use of a group or groups of very large crude oil, natural gas, and/or refined petroleum products storage vessels or tankers located together at one or more predetermined offshore locations. Each group of vessels will be connected together by a manifold. The manifold will connect the storage tank portion of like vessels together as well as connecting the vessels to onshore storage or onshore refineries. To assure security of the vessels, each group of vessels will have its own security system to protect it against militants or others intent on disrupting the storage, export or shipment of crude oil, natural gas, and/or refined petroleum products.

BRIEF DESCRIPTION OF THE DRAWING FIGURES

A better understanding of the disclosed Secure Offshore Storage System and Method of the present invention may be had by reference to the drawing figures wherein.

DESCRIPTION OF THE EMBODIMENTS

Figure 1:
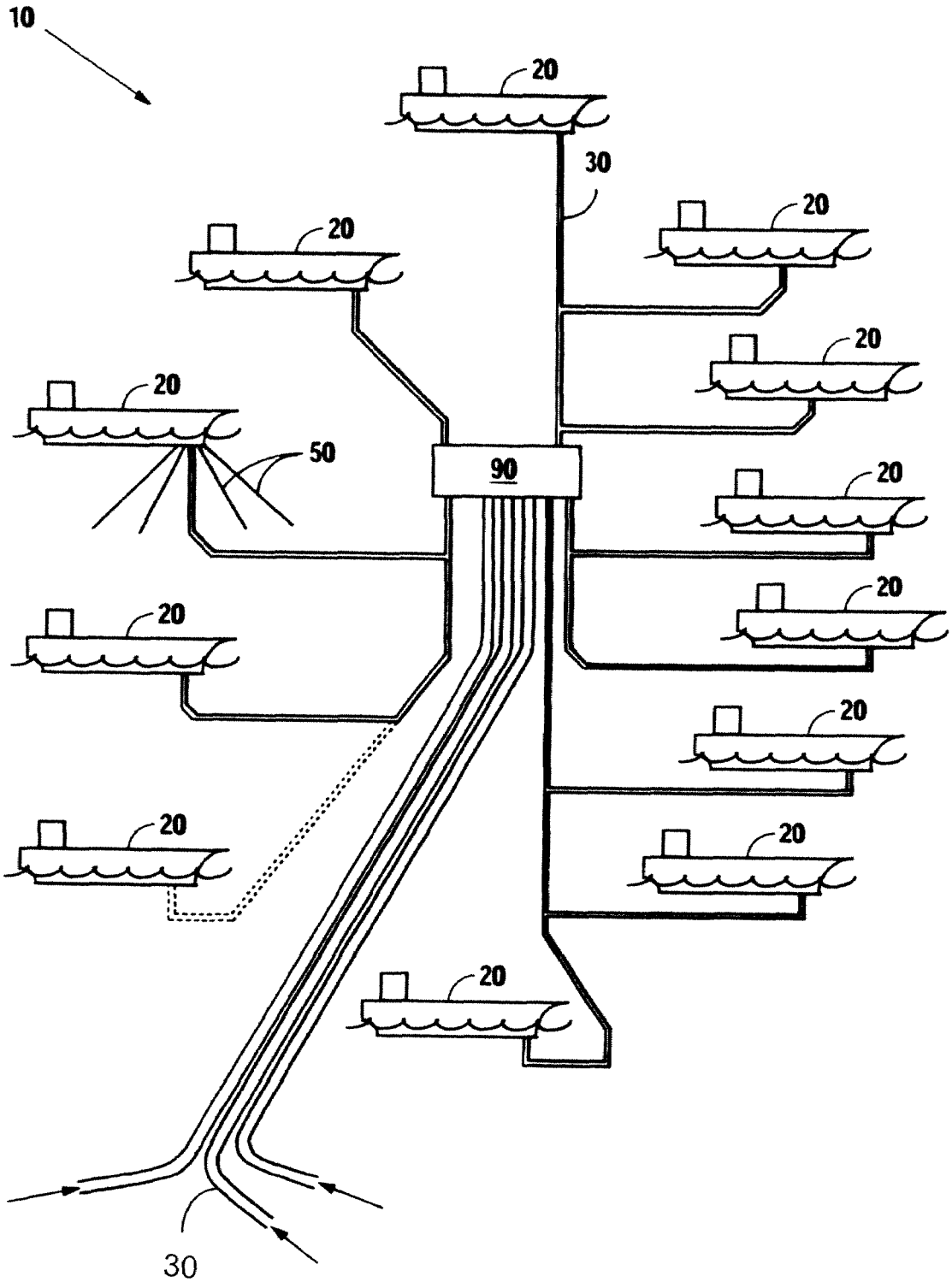
FIG. 1 is a schematic of the system and method of the present invention using a group of twelve vessels.
Figure 2:
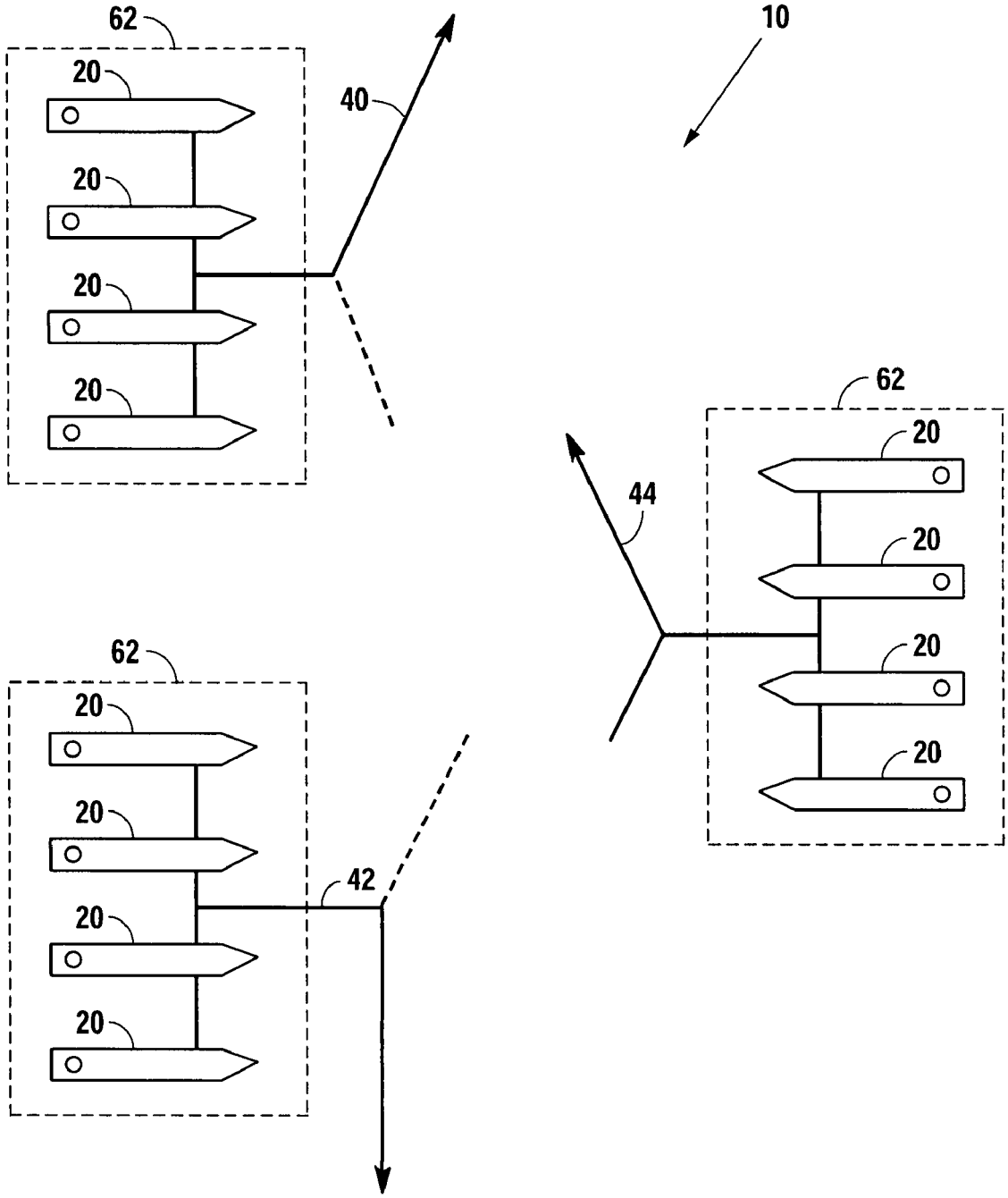
FIG. 2 is a schematic of the system and method of present invention using three groups of four vessels each.

As shown in FIG. 1 and in FIG. 2, the secure offshore storage system and method of the present invention will take on the form of a group of very large crude oil, natural gas, or refined petroleum products storage vessels, typically very large crude carriers of 2,000,000 bbl capacity 20 designated "VLCC," a commonly used size in the tanker industry, which may be arranged in a single group where the storage vessels are from about 2 miles to about 5 miles apart as shown in FIG. 1 or in multiple groups 40, 42, 44 where the storage vessel groups are from about 20 miles to 50 miles apart as shown in FIG. 2. The common characteristic is that each group of storage vessels located about 20 to 50 miles offshore, to be beyond the range of small un-powered watercraft, is connected to onshore storage locations (not shown) and/or to other offshore crude oil production locations by pipeline assemblies 30 (typically subsea) to load or unload each of the very large vessels 20 and provide safe, secure and redundant routes for the transport of crude oil, natural gas, or refined petroleum products. Included within each group of storage vessels may be a fixed structure for controlling the amount of crude oil, natural gas or refined petroleum products temporarily stored aboard each storage vessel as well as controlling the security system for the group of storage vessels.

Figure 4:
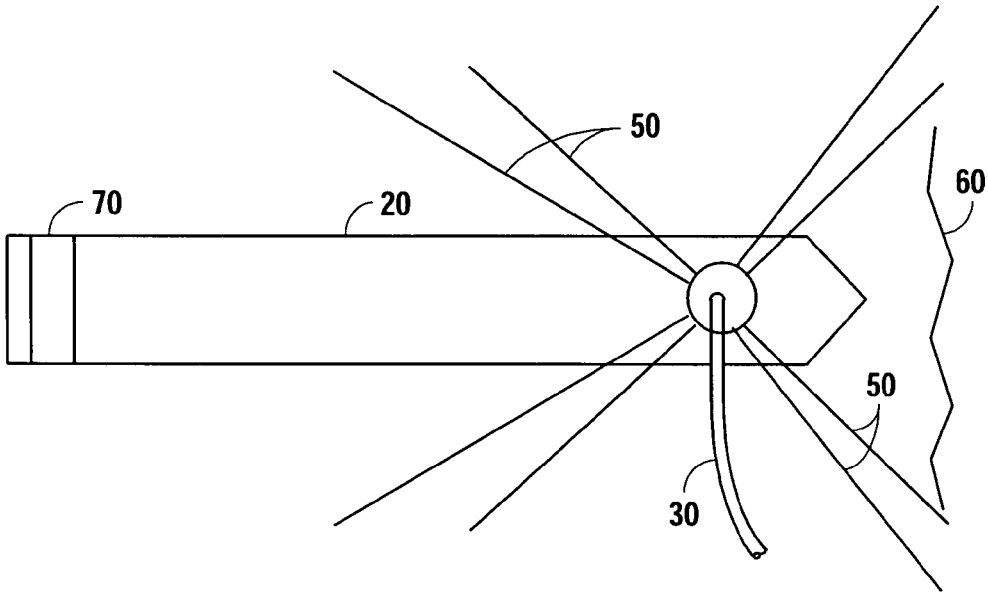
FIG. 4 is a partial plan view of the vessel shown in FIG. 3.

In the preferred embodiment and for the reliability and safety of the offloading of crude oil to tankers for export to other locations, each of the very large crude oil storage vessels 20 will be held in place at ocean depths of from about 250 feet to about 400 feet by a single point mooring system such as an internal (or external) turret 50 or some other mooring and fluid transfer system to maintain the very large crude oil storage vessel 20 on station and to enable weathervaning of the very large crude oil storage vessel 20 in response to wind and wave forces. Transfer of the crude oil from the very large crude oil storage vessel 20 to export tankers will typically employ the use of the ship's export pumps 70 as shown in FIG. 4 and a floating hose from a midship manifold on the very large crude oil storage vessel 20 to a midship manifold located on the export tanker. Such systems are well known in the offshore crude oil transport industry.

In an alternative embodiment the storage of crude oil, natural gas or refined petroleum products may be in storage containers such as bladders or concrete or steel gravity structures located on the ocean floor and connected one to another by one or more manifolds.

The disclosed system and method is a combination of well known Floating Storage Offloading (FSO) vessels; however, the disclosed system and method connects and arranges the FSO's to both provide security and to provide strategic storage of large quantities of crude oil, natural gas, or refined petroleum products.

Figure 3:
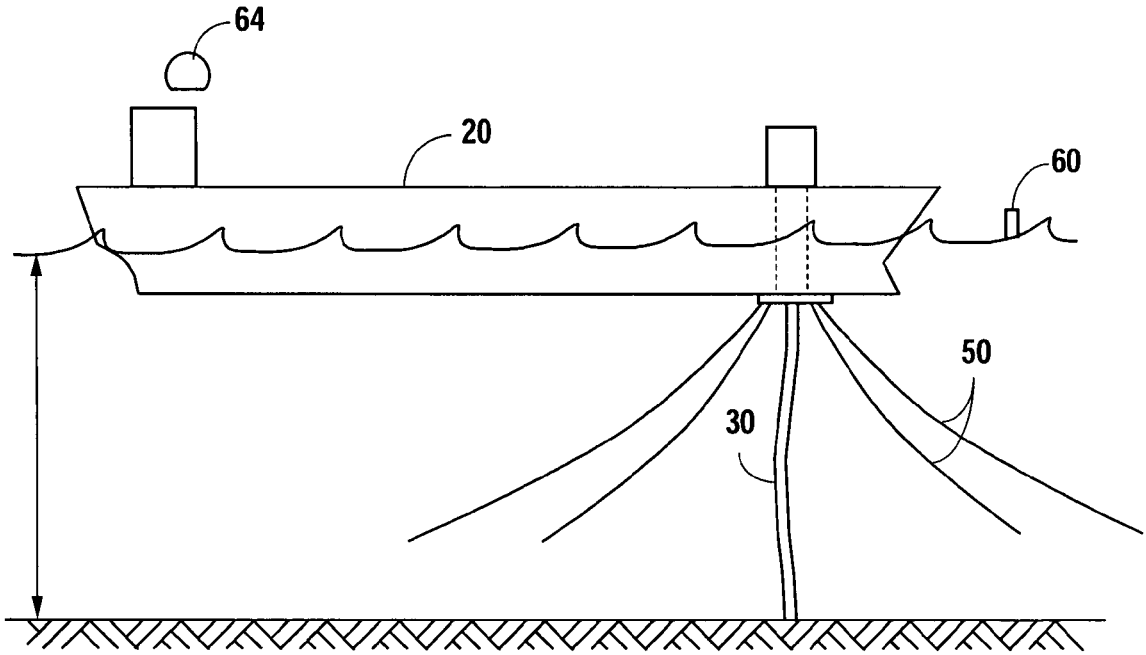
FIG. 3 is an elevational view of a single vessel used in the system and method of the present invention.

The very large crude oil storage vessels 20 shown in the preferred embodiment are equipped both for the loading of crude oil, natural gas, or refined petroleum products produced from a variety of different locations and for the off loading of crude oil, natural gas or refined petroleum products to export tankers. Further, as shown in FIG. 3 and in FIG. 4 each very large crude oil storage vessel 20 is equipped with its own set of floating barriers 60 to prevent small hostile vessels from coming too close to the very large crude oil vessels 20. As shown in FIG. 2, each group of vessels may include its own security perimeter 62. Still other security measures, such as those considered for use in the Gulf of Mexico after the 9/11 attacks in the US at fixed offshore platforms will be installed on and around each very large crude oil storage vessel to enable monitoring of adjacent waters and detect any vessel movements therein. When a vessel is detected which represents a potential threat to a very large crude oil vessel, interdiction forces or methods may be used to first warn and then stop intruders. Such methods may include deterrence means such as high intensity sound beams, focused electromagnetic beams and others, recognizing both.

The very large crude oil storage vessels 20 used will initially be standard vessels which are either purchased or leased. It is envisioned that as the system and method of the present invention is adopted for use around the world, specialty vessels may be designed specifically for use in the disclosed system and method may be used. Such vessels may include concrete or steel tanks which are easily locally manufactured and may be located on the ocean floor. The vessels used with the disclosed system and method may have crude oil, natural gas or refined petroleum product storage capacities well beyond what is presently available.

Each fleet or group of very large storage vessels or tankers will have a central command center located either on one vessel or divided up for enhanced security on multiple vessels. The central command center will provide several functions for the fleet or group of very large storage vessels. Specifically, the central command center will:

- determine which individual vessel 20 in the fleet or group of very large storage vessels is to be filled or emptied;
- determine how much crude oil, natural gas, or refined petroleum products is to be added to or removed from each individual vessel 20 in the group of very large storage vessels either from an on-shore source or from another vessel;
- move security assets as needed within the group of very large storage vessels to include patrol boats, electronic surveillance, air/underwater surveillance etc.

Figure 5:
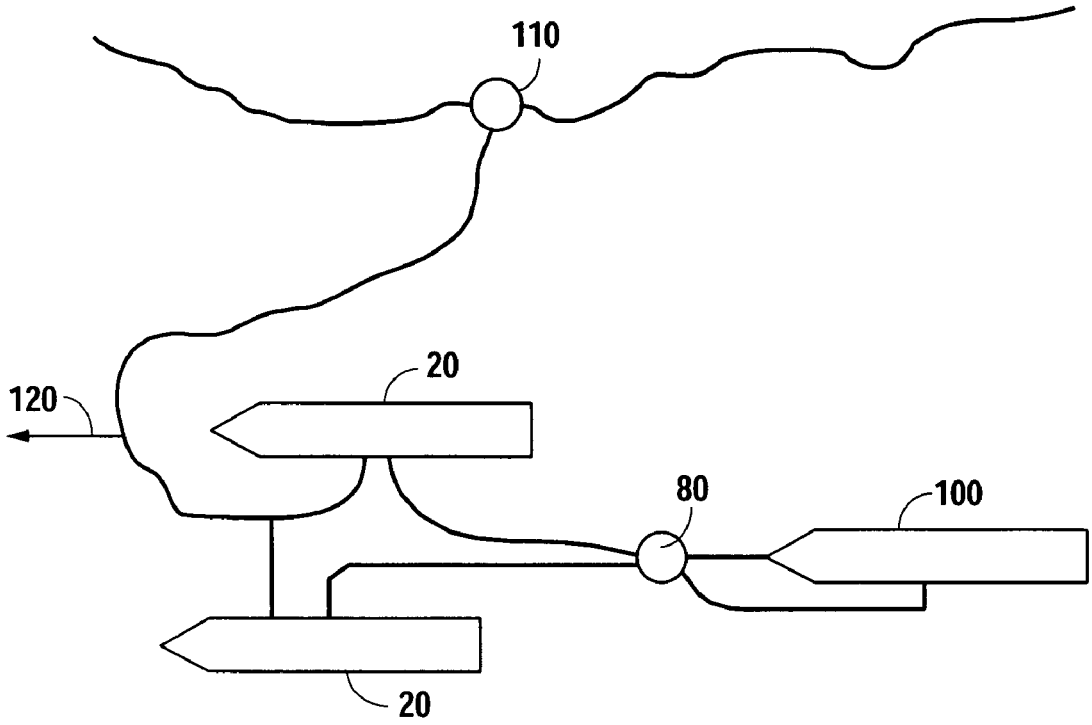
FIG. 5 is a schematic of a typical arrangement of an array of tanker vessels with respect to an on-shore pumping station.

As shown in FIG. 5 offloading of crude oil, natural gas, or refined petroleum products to an export tanker will optionally be from a catenary anchor leg moored (CALM) buoy or from a group of CALM buoys for all of the crude oil, natural gas, or refined petroleum products stored by the fleet or group of vessels. Alternatively, a turret moored tanker may be used to export crude oil, natural gas or refined petroleum products directly to an export tanker 100 that is hawser moored to its stern. If desired, spread moored tankers could be combined with one or more turret moored VLCC's as shown in FIGS. 3 and 4 or alternatively they could be connected to a CALM buoy 80 as shown in FIG. 5. While a group of buoys may be used, it is also possible to offload crude oil from each vessel 20 through a seabed manifold 90 as shown in FIG. 1. Individually provided adequate security measures are put in place by the command center. The vessels 20 may be connected to onshore pumping facilities 110 or to offshore production installations 120.

One premise of the disclosed system and method 10 is that all stored crude oil, natural gas, or refined petroleum products are considered to be fungible. However, it is also possible to accommodate the storage of various different grades or types of crude oil, natural gas, or refined petroleum products within different compartments or tanks of the vessels if such different grades of crude oil, natural gas, or refined petroleum products are producible from either land or offshore sources. The storage of multiple different grades of crude oil, natural gas, or refined petroleum products will be managed by the command center in the same way that the crude oil, natural gas, or refined petroleum products are managed.

It is envisioned that the fees charged for storage of crude oil, natural gas, or refined petroleum products will be on a long term contract service basis. Alternatively, the fees charged for the secure storage of crude oil, natural gas, or refined petroleum products could be priced in a manner similar to the pricing of an insurance policy. Specifically, a predetermined per unit quantity tariff would be charged based on daily production and applied to provide another predetermined number of units from the offshore storage location.

The disclosed offshore storage system and method 10 could also be used to provide a market calming effect in the case of rapidly fluctuating prices. Specifically, enough quantity of stored goods could be released from storage to deter any disruptions in supply (e.g. 600,000 barrels per day reduction in production of crude oil over 50 days or 30,000,000 barrels).

The disclosed offshore storage system and method 10 could also be used to reduce the prices of crude oil, natural gas, and/or refined petroleum products by reducing the price instability premium that producers place on their per unit price. In addition, the reputation of the host country to supply large quantities of crude oil, natural gas, or refined petroleum products when needed would be enhanced as sufficient quantities of those commodities to meet customer demand will be available during any on-shore production interruptions. If multiple countries are involved, the perception of security for the stored crude oil, natural gas, and/or refined petroleum products will be increased, thus further calming fears of a disruption in the supply of crude oil, natural gas, or refined petroleum products originating in a third world country.

The disclosed system in a macro sense is a combination of relatively short delivery components including:

pump stations;
pipelines;
offshore storage vessels;
offloading buoys.

All of the foregoing are arranged and included in sufficient quantities to continue operation if one or more portions is reduced in capacity or destroyed.

For additional storage needs the fleet or groups of vessels may be increased in size by the addition of more vessels or by combination with other types of either surface or concrete gravity storage structures whether such storage structures be mobile or stationary. Accordingly, such an increase in the number of vessels will be tied into the command center for control and security.

In particularly dangerous locations, it may be necessary to have multiple layers of security; possibly provided by all countries having an interest in assuring the security of the stored crude oil, natural gas, or refined petroleum products. Such layered security may include various functionalities to include radar monitoring, air and/or water patrols, incident interdiction, communication, line monitoring and emergency rescue. New types of sensors and non-lethal weapons developed after the 9/11 attacks may be used. For example, new surveillance radar, intense focused audio beams such as LRAD, and microwave equivalents 64 can be used as shown in FIG. 3.

Each storage vessel should have a double hull to protect against suicide attackers, collisions, or missile attacks. This additional protection satisfies regulatory requirements in first world countries such as the United States—so that the most stringent requirements can be met.

Transportation within the fleet or group of vessels may be by helicopter to helipads located on each vessel. Such helipads should be made large enough for use by large helicopters in the event of the need for the movement of large numbers of people or equipment.

The disclosed system and method has been disclosed according it its preferred and alternate embodiments. Those of ordinary skill in the art will realize that based on the foregoing disclosure other embodiments have been enabled. Such other embodiments shall be included within the scope and meaning of the appended claims.

What is claimed is:

1. A secure offshore crude oil, natural gas, and/or refined petroleum products storage system comprising:

a group of vessels which includes a plurality of storage vessels selected from a group including crude oil storage vessels, natural gas storage vessels, and refined petroleum products storage vessels;

said storage vessels being connected to a seabed manifold;

said seabed manifold being connected to sources of crude oil, natural gas, or refined petroleum products;

a central command center for:

determining which individual vessel within said group of storage vessels is to be emptied or filled;

determining how much crude oil, natural gas, and/or refined petroleum products is to be added or removed from each storage vessel in said group of storage vessels;

moving security assets within said group of storage vessels, said security assets being selected from a group including but not limited to: patrol boats, electronic surveillance, and air/underwater surveillance;

each of said storage vessels within said group of storage vessels, having an associated security system;

each of said storage vessels within said group of storage vessels having a mooring system allowing said storage vessel to weathervane in response to wind and wave forces.

2. The system as defined in claim 1 wherein individual storage vessels within said group of storage vessels offload to an export tanker using at least one CALM buoy.

3. The system as defined in claim 1 wherein individual storage vessels within said group of storage vessels offload to an export tanker from a turret moored vessel.

4. The system as defined in claim 1 wherein individual storage vessels within said group of storage vessels offload to an export tanker from a spread moored vessel.

5. The system as defined in claim 1 wherein different grades of crude oil, natural gas, and/or refined petroleum products may be stored within individual storage vessels within said group of storage vessels.

6. A method for storing crude oil, natural gas, and/or refined petroleum products in a secure manner offshore, said method comprising the steps of:

locating a plurality of offshore storage vessels as a group at an offshore location;

equipping each of said storage vessels with a security system;

connecting each of said storage vessels within said plurality of offshore storage vessels to a common seabed manifold;

connecting said common seabed manifold to sources of crude oil, natural gas, and/or refined petroleum products, connecting each of said storage vessels within said plurality of offshore storage vessels to a central command center for:

determining how much crude oil, natural gas, and/or refined petroleum products is to be added to or removed from each storage vessel within said plurality of offshore storage vessels;

moving security assets within said plurality of offshore storage vessels, said security assets being selected from a group including, but not limited to: patrol boats, electronic surveillance equipment, and air/underwater surveillance.

7. The method as defined in claim 6 wherein said step of locating a plurality of storage vessels as a group at an offshore location includes using a mooring system which allows each vessel within said plurality of offshore storage vessels to weathervane in response to wind and wave forces.

8. The method as defined in claim 6 wherein one or more vessels in said plurality of vessels includes a system for offloading to an export tanker not included in said plurality of storage vessels.

9. The method as defined in claim 6 wherein one or more vessels in said plurality of vessels is connected to a CALM buoy.

* * * * *